US006827206B2

(12) United States Patent
Brase et al.

(10) Patent No.: US 6,827,206 B2
(45) Date of Patent: Dec. 7, 2004

(54) PACKAGING CONTAINER FOR A LARGE-CALIBER CARTRIDGE

(75) Inventors: Holger Brase, Bergen (DE); Thomas Heitmann, Unterlüss (DE)

(73) Assignee: Rheinmetall W & M GmbH, Unterluss (DE)

( * ) Notice: Subject to any disclaimer, the term of this patent is extended or adjusted under 35 U.S.C. 154(b) by 184 days.

(21) Appl. No.: 10/162,763

(22) Filed: Jun. 6, 2002

(65) Prior Publication Data

US 2002/0185386 A1 Dec. 12, 2002

(30) Foreign Application Priority Data

Jun. 7, 2001 (DE) ..... 101 27 645

(51) Int. Cl.[7] ..... F42B 39/00

(52) U.S. Cl. ..... 206/3; 206/371; 206/523; 206/591

(58) Field of Search ..... 206/3, 371, 521, 206/523, 524, 587, 591–594, 446

(56) References Cited

U.S. PATENT DOCUMENTS 3,368,452 A * 2/1968 Fredrickson et al. ..... 89/1.816
4,055,247 A * 10/1977 Benedick et al. ..... 206/3
4,677,894 A * 7/1987 Pongratz et al. ..... 86/45
4,722,436 A * 2/1988 Moraine ..... 206/3
4,762,222 A * 8/1988 Martin ..... 206/3
5,779,031 A * 7/1998 Moraine et al. ..... 206/3
6,019,217 A * 2/2000 Melan et al. ..... 206/3

* cited by examiner

*Primary Examiner*—Jila M. Mohandesi
(74) *Attorney, Agent, or Firm*—Venable LLP; Stuart I. Smith

(57) ABSTRACT

A packaging container is provided for a large-caliber cartridge having a thin-walled cartridge case and a projectile, whose projectile head projects out of the front of and is connected to the cartridge case. The packaging container has an outer container and an inner container, which receives the cartridge. To secure the projectile of the cartridge inside the packaging container, with respect to a possible displacement of the projectile toward the rear end of the container, the projectile head of the cartridge is disposed in the inner container in a frictional lockup. For this purpose, the inner container has a one-piece projectile-head shaped receptacle at the front, to which a first half-shell that partially surrounds the cartridge case is connected, and a second half-shell, that is hinged to the first half-shell and can be secured to it.

9 Claims, 2 Drawing Sheets

PACKAGING CONTAINER FOR A LARGE-CALIBER CARTRIDGE

CROSS-REFERENCE TO RELATED APPLICATION

This application claims the priority of German Patent Application No. 101 27 645.1 filed Jun. 7, 2001, which is incorporated herein by reference.

BACKGROUND OF THE INVENTION

The invention relates to a packaging container for a large-caliber cartridge having a thin-walled cartridge case and a projectile, whose projectile head projects out of the front of the cartridge case and is connected to it.

German published Patent Application No. DE 195 14 988 A1 discloses a packaging container for large-caliber cartridges having a cartridge case and a small-caliber projectile. Because the projectile in large-caliber cartridges, especially those with a combustible cartridge case, is typically much heavier than the drive component, the projectile must be supported inside a support tube by corresponding, form-fitting plastic or fibrous elements to prevent damage to the cartridge case if the packaging container falls toward the casing bottom.

In large-caliber full-caliber projectiles, the projectile head typically has a smooth surface, in contrast to small-caliber projectiles, so in corresponding packaging containers, form-fitting support elements cannot securely fix the projectile head inside the container at a justifiable cost.

German published Patent Application No. 198 12 633 A1 discloses a packaging container in which the use of an inner case, which is supported against the rear side of the case and is connected at its front end to a spreader ring having radial, resilient claws, prevents a full-caliber projectile from being displaced toward the rear end of the container if the packaging container falls toward the casing bottom. When a cartridge is located in the packaging container, the claws press against the outside wall of the projectile head and create a frictional connection between the inner case and the projectile head.

The primary drawback of this packaging container is that the frictional lockup of the spreader ring impedes both the insertion and removal of the cartridge in the axial direction. The geometry and material of the spreader ring must be selected to assure a sufficient pressing force for effecting a diversion of the force of the projectile head across the packaging parts and into the casing bottom if the packaging falls axially, despite the relaxation of the ring material after a certain length of time.

It is the object of the invention to provide a packaging container in which the projectile of the respective cartridge is securely supported with respect to a possible displacement of the projectile toward the rear end of the container, even if the projectile is a full-caliber projectile whose head has a smooth surface.

SUMMARY OF THE INVENTION

In accordance with the invention, the above object generally is achieved by a packaging container for a large-caliber cartridge having a thin-walled cartridge case and a projectile, whose projectile head projects out of and in connected to the front of the cartridge case, with the container comprising an outer container and an inner container, which receives the cartridge and can be axially inserted into and withdrawn from the outer container. The inner container includes a projectile-head receptacle at the front, with the receptacle being connected at its rear to a first half-shell, which partially surrounds the cartridge case, and a second half-shell, which is hinged to the first half-shell and can be secured to it. The end region of the projectile-head receptacle facing the first half-shell, and the end region of the second half-shell facing the projectile-head receptacle are formed as complementary retaining shells (or are connected to complementary retaining shells) that surround the rear region of the projectile head in a frictional lockup or a form-fit during use of the packaging container for a projectile. Further, particularly advantageous embodiments of the invention likewise are disclosed.

The invention is essentially based on the concept of disposing the cartridge in an inner container for producing a frictional lockup for the projectile bead, the container having a projectile-head receptacle at the front, to which a first half-shell that partially surrounds the cartridge case is connected, and a second half-shell, which is hinged to the first half-shell and can be secured to it, with the end region of the projectile-head receptacle that faces the first half-shell and the end region of the second half-shell that faces the projectile-head receptacle being formed as complementary retaining shells, and/or being connected to retaining shells that surround the rear region of the projectile head in a frictional lockup and/or a form-fit in the intended use of the packaging container.

In the packaging container of the inventions therefore, the direction of force for moving the cartridge and the axial force deflection are decoupled from one another when the packaging container falls toward the casing bottom, so the latching in the circumferential direction and the axial force absorption can be optimized extensively independently of one another.

To assure a frictional lockup with the aid of the retaining shells, it has proven advantageous for the shells to comprise a deformable material, particularly an elastomer plastic, because the retaining shells can adapt precisely to the projectile contour during the latching process, which produces a correspondingly good frictional connection between the projectile and the retaining shells.

Further details about and advantages of the invention ensue from exemplary embodiments described below with reference to drawing figures.

DESCRIPTION OF THE PREFERRED EMBODIMENTS

Figure 1:
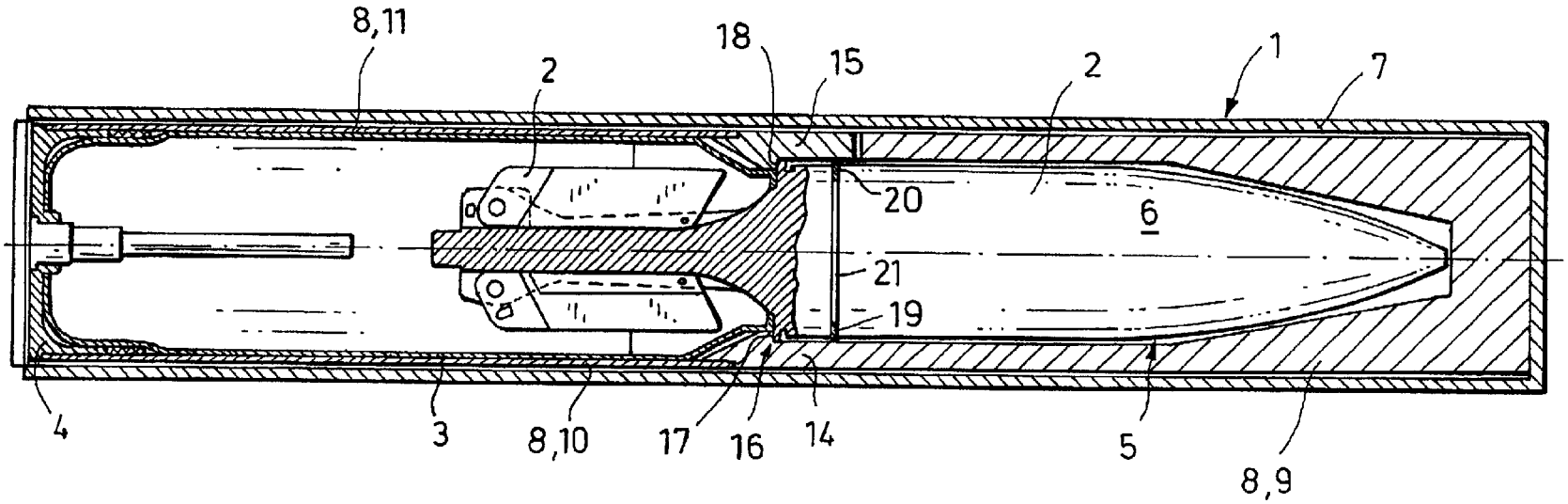
FIG. 1 is a longitudinal section through a packaging container in accordance with the invention, having an outer container and an inner container, and a cartridge in the inner container.

FIG. 1 shows a packaging container 1 for a large-caliber cartridge 2, which has a relatively thin-walled cartridge casing 3 comprising a combustible material, a solid casing bottom 4 comprised of metal, and a fin-stabilized, full-caliber projectile 5, whose projectile head 6 projects out of the front of the cartridge casing 3.

The packaging container 1 comprises an outer tubular container 7 that, as shown, preferably is closed at one end, and an inner container 8, which receives the cartridge 2 and can be inserted axially into and removed from the outer container 7 via its open end. At the front, i.e., adjacent the closed end of the outer container 7, the inner container 8 has a plastic, preferably polyethylene, projectile-head receptacle 9 whose interior preferably is shaped to conform to the projectile head. A first half-shell 10 partially surrounding the cartridge casing a is rigidly connected to a rear end of the receptacle 9, with the half-shell 10 comprised of a fibrous material.

Figure 2:
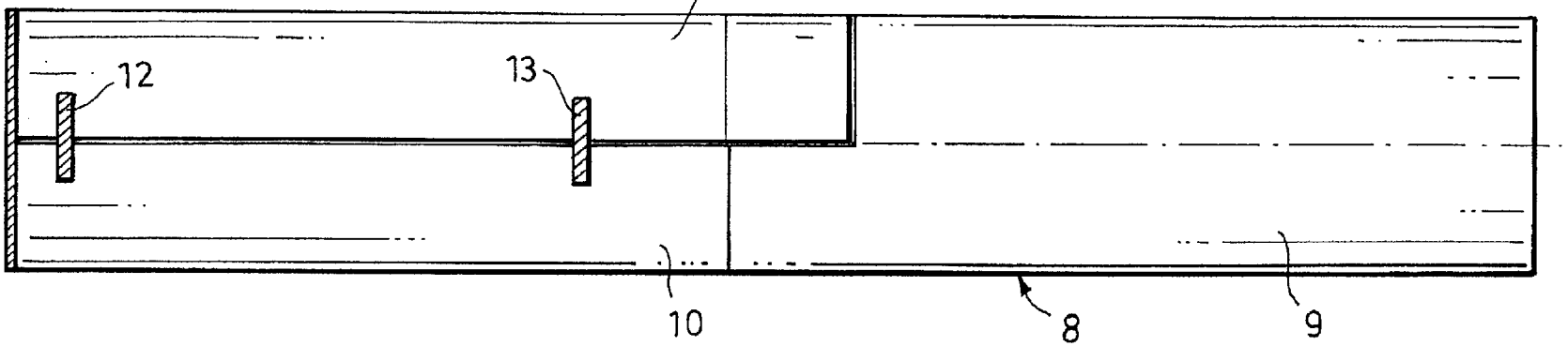
FIG. 2 is a side view of the inner container with latched half-shells.

A second half-shell 11, which also is comprised of a fibrous material, is hinged to the first half-shell 10, and can be secured to the first half-shell 10 by two axially-spaced latching devices 12 and 13, e.g., Velcro straps(See FIG. 2). The hinge may likewise be formed of two such spaced velcro straps or be any other suitable hinge.

The rear end region of the projectile receptacle 9 facing the first half-shell 10, and the front end region of the second half-shell 11 facing the projectile receptacle are formed as respective complementary retaining shells 14, 15, which surround the rear region 16 of the projectile head 6 in a frictional lockup, and are also made of polyethylene.

The two retaining shells 14, 15 also have a inwardly directed radial respective projection 17, 18 that protrudes into the inner container 8. These projections 17 and 18 extend behind the rear of the projectile head 6, thus preventing the projectile 5 from sliding in the direction of the casing bottom 4 of the cartridge 2, i.e.( the axial direction of the container 8.

The retaining shells 14, 15 are provided with two further inwardly radially extending projections 19, 20, which extend into a corresponding annular groove 21 or the outer surface of the projectile head 6 and likewise prevent the projectile S from sliding toward the casing bottom 4.

In the intended use of the packaging container 1, the cartridge 2 is inserted projectile-first into the projectile-head receptacle 9 and with the cartridge case 3 inserted into the first half-shell 10. The second half-shell 11 is then secured to the first half-shell 10 by the Velcro straps 12, 13, and the latched inner container a is inserted, with the cartridge 2, axially into the outer container 7.

Figure 3:
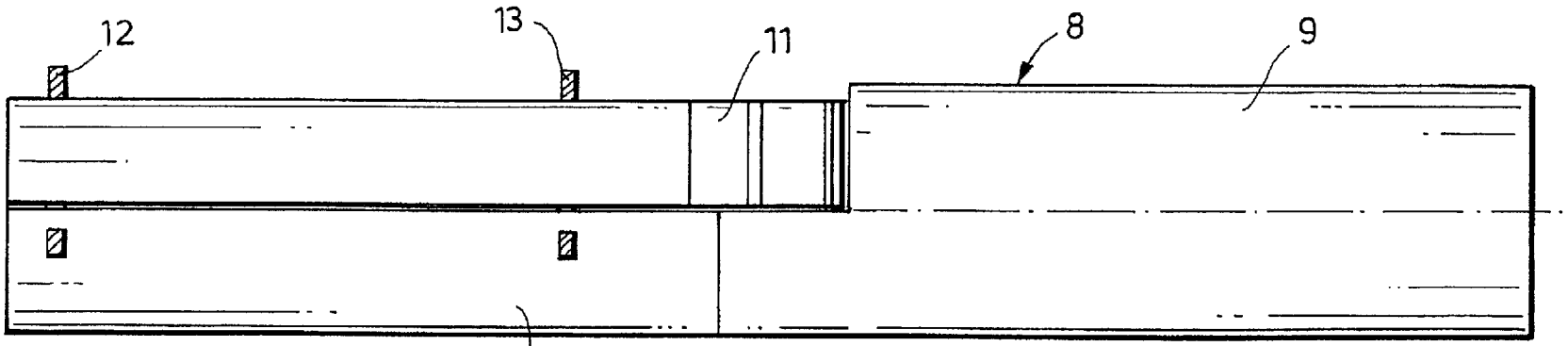
FIG. 3 is a side view of the inner container with the second half-shell being folded back after the cartridge has been removed.

For removing the cartridge, the inner container 8 is axially pulled about two-thirds out of the outer container 7, for example, by an extraction strap (not shown) secured to the inner container 8. The Velcro straps 12, 13 are released, and the second half-shell 11 is folded back (See FIG. 3). The cartridge 2 can then be removed. After removal, the two half-shells 10, 11 are folded together again and the inner container 8 is pushed back into the outer container 7.

The invention now being fully described, it will be apparent to one of ordinary skill in the art that many changes and modifications can be made thereto without departing from the spirit or scope of the invention as set forth herein.

What is claimed is:

1. A packaging container for a large-caliber cartridge having a thin-walled cartridge case and a projectile, whose projectile head projects out of the front of and is connected to the cartridge case, said packaging container comprising:

an outer tubular container and an inner container, which receives the cartridge and can be inserted axially into and withdrawn from the outer container;

said inner container having a one-piece projectile-head shaped receptacle at a front end thereof for receiving the projectile head, a rear end of the one-piece receptacle being connected to a first half-shell that has an internal shape that partially surrounds an inserted cartridge case, and a second half-shell that is hinged to the first half-shell and can be secured to the first half shell, and has an internal shape that surrounds a remaining portion of the inserted cartridge case;

an end region of the one-piece receptacle facing the first half-shell, and an end region of the second half-shell facing the one-piece receptacle are each formed as complementary retaining shells, or are connected to complimentary retaining shells, that surround a rear region of an inserted projectile head in at least one of a frictional lockup and a form-fit.

2. The packaging container according to claim 1, wherein the half-shells each have at least one projection that protrudes radially inwardly into the inner container for extending, with a form fit, behind a rear end of the projectile head, or into a recess in a rear region of an inserted projectile head.

3. The packaging container according to claim 2, wherein the half-shells are comprised of an elastomer plastic.

4. The packaging containing according to claim 1, wherein the half-shells are comprised of an elastomer plastic.

5. The packaging container according to claim 1, wherein the two half-shells are comprised of a fibrous material.

6. The packaging container according to claim 1, wherein the one-piece projectile-head receptacle is comprised of plastic.

7. The packaging container according to claim 6, wherein the one-piece projectile-head receptacle is comprised of polyethylene.

8. The packaging container according to claim 1, wherein the two half-shells are connected to one another by at least two axially-spaced latching devices.

9. The packaging container according to claim 1, wherein the outer container is closed at one end.

* * * * *